United States Patent [19]

Ehlermann

[11] Patent Number: 4,556,353

[45] Date of Patent: Dec. 3, 1985

[54] PROCESS AND APPARATUS FOR BINDING BOOKS

[76] Inventor: Hans-Dieter Ehlermann, Hinter dem Paschberg 8, D-2810 Verden-Scharnhorst, Niedersachsen, Fed. Rep. of Germany

[21] Appl. No.: 550,961

[22] Filed: Nov. 10, 1983

[30] Foreign Application Priority Data

Nov. 10, 1982 [DE] Fed. Rep. of Germany ..... 3241477

[51] Int. Cl.[4] ..... B42C 11/00; B42C 11/02; B42C 11/08; B42C 9/00

[52] U.S. Cl. ..... 412/5; 412/19; 412/20; 412/37

[58] Field of Search ..... 412/4, 5, 7, 8, 9, 10, 412/39, 19, 21, 37; 156/477 B

[56] References Cited

U.S. PATENT DOCUMENTS

| | | | |
|---|---|---|---|
| 1,867,803 | 7/1932 | Bredenberg | 412/9 |
| 3,085,265 | 4/1963 | Biel et al. | 412/9 |
| 3,451,082 | 6/1969 | Sarring | 412/5 |
| 3,708,813 | 1/1973 | Carter et al. | 412/5 |
| 3,925,126 | 12/1975 | Leatherman et al. | 412/5 |
| 4,091,487 | 5/1978 | Axelrod | 412/5 |
| 4,150,453 | 4/1979 | Vaughn | 412/5 |

FOREIGN PATENT DOCUMENTS

| | | |
|---|---|---|
| 2264336 | 7/1973 | Fed. Rep. of Germany . |
| 2257614 | 5/1974 | Fed. Rep. of Germany . |
| 2106496 | 11/1974 | Fed. Rep. of Germany . |
| WO81/03644 | 12/1981 | PCT Int'l Appl. . |
| 613791 | 12/1948 | United Kingdom . |
| 1262081 | 2/1972 | United Kingdom . |

*Primary Examiner*—R. L. Spruill
*Assistant Examiner*—Paul M. Heyrana

[57] ABSTRACT

In a process and apparatus for binding books, upper (forward) portions of bookblocks in a vertical position with backs down are gripped by clamps on a conveyor for transporting the bookblocks through successive operating stations. At one operating station a rotating element dipping in a bath of adhesive applies adhesive in transverse strips to backs of bookblocks. At another operating station rollers apply adhesive to lower (rear) portions of first and last pages of the bookblocks. As front and back covers connected by a back are transported, inside up, along a path merging with the path along which said bookblocks are transported, adhesive is applied by rollers or spray heads to outer (forward) portions of the front and back covers. The covers are brought under respective bookblocks and lower (rear) portions of the bookblocks together with the covers are gripped between opposed pressing bars. As the bookblock with the cover thereon is further advanced in a guide channel, the clamp is removed and the book passes between pairs of opposed rollers which engage lower (rear) portions. Finally the books are pressed between opposed pressure plates before being discharged to a delivery system or to storage.

24 Claims, 22 Drawing Figures

PROCESS AND APPARATUS FOR BINDING BOOKS

FIELD OF INVENTION

The invention relates to a process of binding books in which a cover comprising a front cover, back cover and connecting back portion is applied to a book block and adhesively secured thereto and to apparatus for carrying out the process.

BACKGROUND OF THE INVENTION

There are different processes for binding books depending on the construction of the books. For brochures, the cover and back consists of a single piece of heavy paper or cardboard which is adhesively secured to the book block only in the region of the back. The process in accordance with the present invention is not intended for such brochures. All other book binding methods have a book block which is bound with a quality cover so that a better and more lasting binding between the cover and the book block is achieved. With thread bound books, a part of the back gauze projects forwardly from the back and heretofore the book cover was joined in usual manner by a joining machine after the entire inner face has been coated with adhesive. Also, with an adhesive bound book block with back gauze, a stiff cover is attached in like manner. The production cost is relatively high and it can be very high.

The rate of production is relatively low. This results to a large extent from the need of applying adhesive to the full face and gluing it to the cover. Also with other gluing processes, for example in the production of children's books in which the cover and back are fixed to an inner book part or book block made up of sheets laminated together, it is necessary to use a suitable binding process. Moreover, for a quality book with a semi-hard cover and a binding with the help of a liner, at least a continuous liner, it is necessary to use additionally a continuous guaze strip in order to increase the strength of the binding. Also, in this "semi-hard-cover" book binding art it has heretofore been necessary to work with the usual liner and binding machine which limits the output capacity. For all of these book binding processes there is a need of increasing the rate of production and of securing a high quality binding with simple machines.

SUMMARY OF THE INVENTION

It is an object of the invention to provide a process and apparatus with which it is possible to glue the outer sheets of a book block to a cover rapidly in a continuous process with the book block held by a clamp. A basic idea of the process in accordance with the invention is that glue is applied to rear portions of the first and last pages of the book block and to forward portions of a cover whereupon the cover and book block are brought together. The invention thus departs from the usual method of applying glue to the entire surface and divides the surfaces to be glued in two areas whereby glue is applied to one surface area on one of the parts to be joined and on the other surface area of the other part to be joined. Thereby during the production, the part not to be glued can be gripped by holding and forwarding means so that the parts of the book, namely the book block on one hand and the cover on the other hand, can be held and moved at high speed while applying glue to the areas to be glued. The process is especially suitable for books with elastic covers as these can be sent without damage. However, basically the process does not depend on how the cover is formed and which binding method is selected for the cover, whether this is thread binding or glue binding, and whether the back of the cover remains free or is bound fast to the back of the book block. It does not matter whether a gauze strip is used although this is usually desirable. Also, a folded insert need not necessarily be used since the outermost sheets of the book block can be glued directly to the cover, as is for example the case with book blocks of children's books formed of folded and glued-together sheets, or also with simple brochures which, however, are provided with a stiffer glued-on cover and in which a part of the gauze strip is glued between the cover and the outer sheets of the book block so as to produce a stronger bond than with a simple brochure. On the otherhand, the production expense of a folded insert can be avoided. From other gluing technics in the field of book binding, in particular in back gluing, it is known to apply glue in areas. However, as a rule, this is for the purpose of working with different glues. Thereby the surfaces to be glue are divided into different surface areas. However, these known technics give no suggestion of dividing the whole are into different glue areas, and if necessary applying glue with different technics, and then joining the glued faces for they do not deal with the question of handling by transport and holding means in the area of the surfaces to be glued. Heretofore the process and apparatus were such that the surfaces to be glued could not be held during the gluing process. However, through the dividing of the glue surfaces into different glue areas, it is now possible to hold both parts securely and to bring them together to be joined.

The glue application on the two surface portions can be different from one another and can be carried out in known manner, for example with a glue roller or a glue spray, whereby one glue stripe can be applied with a glue roller and another with a spray. During the greater part of the binding process the book block is expediently held in a clamp of an at least partially automatic machine, whereby portions adjacent the back of the book block extend beyond the clamp edges. In these projecting portions glue can advantageously be applied with a glue roller.

As a glue requiring a long time to set is as a rule used in book binding, the process can be carried out more rapidly by applying the glue in spots to limited surface areas so that it sets rapidly and indeed in such areas a good bond between the cover and the book block is obtained. For example, glue points or glue lines can be applied to the back shortly before the cover is applied, thus before the glue hardens. Thus a hot melt adhesive or other fast setting glue is particularly suitable. A slow setting glue can then be used in the remaining glue areas and on account of the immediate fixing of the cover to the book block, further operations can be performed in spite of the rapid rate.

According to the construction and operation of the machine, the cover can be brought to the book block for example by being laid on a correspondingly coated book block from above. For an especially fast and propitious operation according to a further embodiment of the invention, the back and cover lying flat in a horizontal plane are brought under a book block of which the pages are vertical and the back is down. The back and parts of the cover are then pressed together after applying fast setting glue points or glue stripes. Portions of the cover are thereupon pressed against the part of the book block which extends from the clamp by means of pressure rolls, pressure discs or pressure tongues. The clamp is then released and the entire cover sides are pressed against the book block by pressure rollers or flat pressure plates.

The application and pressing of the cover on the book block can be effected continuously by guiding means such as guiding strips or guiding surfaces. However, timewise it is advantageous to effect the pressing with rollers or stationary pressing elements.

The process in accordance with the invention can very simply be carried out with conventional automatic book binding equipment which is modified so that the book block is held at a great distance from the back and that the corresponding glue-applying rollers and/or sprays are arranged along the path of travel of the book blocks in proper location and in proper manner with the corresponding time control. The expense is substantially less than for conventional pregluing and binding machines.

Apparatus for carrying out the process of binding a book according to the characteristics described above has at least the following operative parts:

a base frame with guiding and driving means transport means carrying clamps for the book blocks an arrangement for transporting book blocks with the areas to be glued projecting from the clamps an arrangement for supplying covers in the form of front and back covers and a connecting back portion an arrangement for applying points or stripes of fast setting glue to the book block and/or back and/or cover portions an arrangement for applying glue to rear portions of first and last pages of the book blocks an arrangement for applying glue to forward portions of the cover an arrangement for pressing the cover on the portions of the book block adjacent the back an arrangement for releasing the book blocks from the clamps an arrangement to apply the covers to the remaining surfaces of the book block to be glued at least one arrangement for pressing the glued surfaces.

BRIEF DESCRIPTION OF DRAWINGS

The nature, objects and advantages of the invention will be more fully understood from the following description of preferred embodiments shown schematically in the accompanying drawings in which.

DESCRIPTION OF PREFERRED EMBODIMENTS

Figure 1:
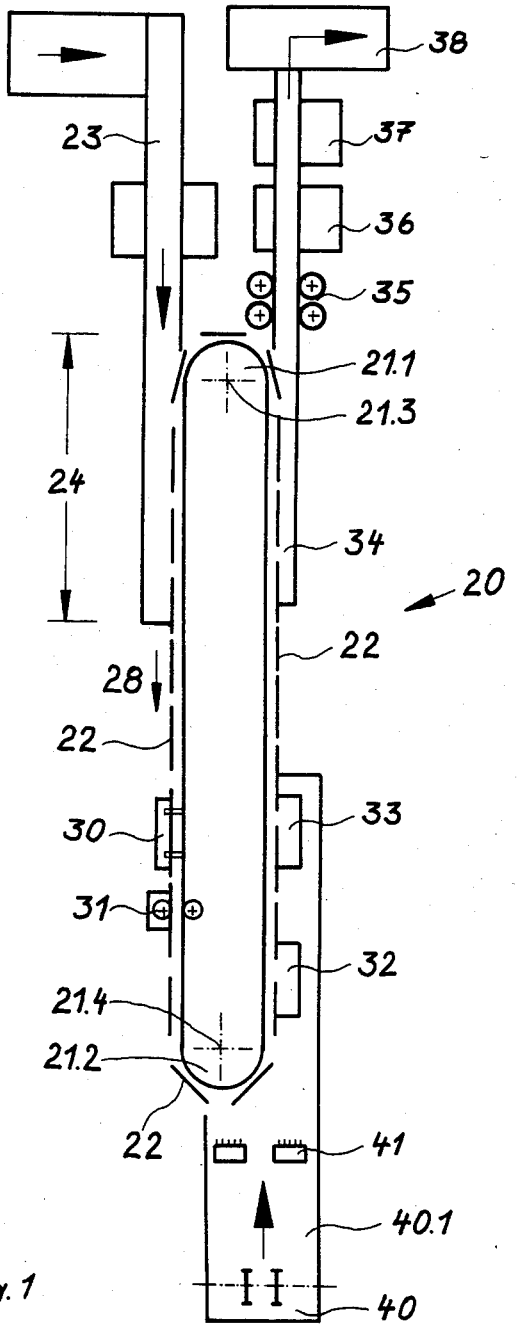
FIG. 1 is a schematic plan view of apparatus for binding books in accordance with the invention including means for transporting book blocks, means for applying adhesive to them, means for transporting and applying adhesive to covers, means for bringing the covers and bookblocks together and pressing them.

FIG. 1 is a plan view showing schematically apparatus 20 for binding books in accordance with the present invention. Individual operating stations are shown in more detail schematically in FIGS. 2 to 11.

The apparatus 20 has two driving and guiding wheels 21.1 and 21.2, the axes 21.3 and 21.4 which are shown by intersecting lines. The driving and guiding wheels rotate about these vertical axes. They are driven in usual manner and carry transport means, for example an endless chain carrying clamps 22. The clamps comprise two parallel flat plates 22.1 and 22.2 with a fastening and feed pin 22.3 of which the control and fastening are not more fully shown in FIGS. 2, 3, 8 and 9 since they are known and usual. By a supply arrangment 23, with supply and guide channels and driving means in known manner, book blocks 25 are fed to the clamps 22 and in zone 24 are taken by the clamps as shown in FIGS. 2 to 5 and 8 so that the portions 27 adjacent the back 26 project downwardly from the clamp 22 a distance of for example 5 to 6 cm. The direction of travel of the clamp 22 is indicated by the arrow 28. After being introduced into and clamped by the clamps 22 in the zone 24, the book blocks 25 are transported first to the back gluing station 30 and then to the side gluing station 31 as is illustrated in more detail in FIGS. 2 to 5. The book blocks then pass around the drive wheel 21.2 into the back run of the transport path. There they proceed to the cover-applying station 32 and further to the cover and side pressing station 33. A certain distance beyond the book blocks 25 are released from the clamps 22 and proceed in a transport channel 34 to the roller pressing station 35 which is shown in more detail in FIG. 10. The book blocks then proceed to the lower pressing station 36 and then to the upper pressing station 37 and finally to the discharge 38. Such path of travel is usual in machines of this kind but the above-mentioned special stations are not arranged in this manner. For supplying covers there is provided a schematically shown cover feeder 40. Following this is a cover gluing station 41. There is provided a suitable schematically illustrated transport system. The cover supplying system will be described more fully with reference to FIGS. 6 to 8. It is so formed and arranged that the flat-lying covers are brought under the cover applying station 32.

Figure 2:
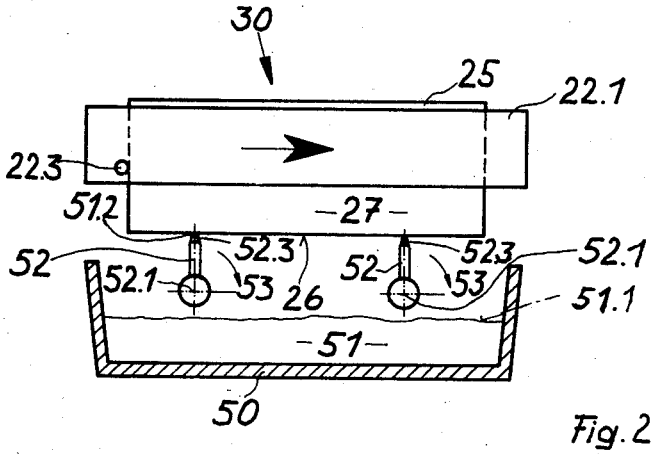
FIG. 2 is a schematic side view partially in section of means for applying stripes of adhesive to bookblocks backs.
Figure 3:
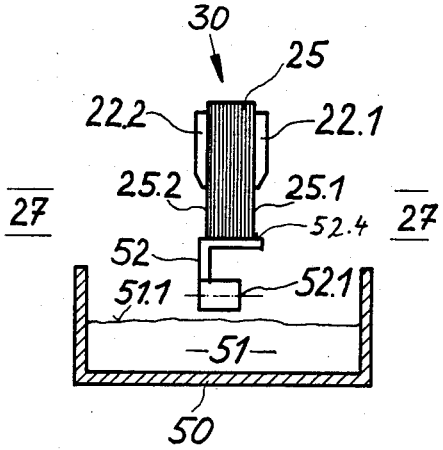
FIG. 3 is a schematic end view partially in section of the adhesive applying means of FIG. 2, omitting transport means.

As illustrated in FIGS. 2 and 3 the glue applying station 30 for applying glue to the backs of the book blocks comprises a glue trough 50 containing glue 51 with an upper surface 51.1. Two stripe gluing arms 52 are rotatable about horizontal axes 52.1 which are spaced from one another and arranged above the glue surface 51.1 so that the glue stripe applicators 52.3, rotating in the direction of the arrows 53 which corresponds to the transport direction 28 of the book blocks and in timed relation with the book block transport, dip into the glue 51 and by their outer faces 52.4 apply narrow glue stripes 51.2 at the ends or spaced from the ends of the book block on the back 26 of the book block 25 as illustrated in FIGS. 2 and 3. As seen in FIGS. 2 and 3, the glue strip applicators comprise L-shaped arms extending from a hub portion, the length of the outer arm corresponding to the thickness of the book block. For the sake of simplicity support means for the glue troughs and the bearings are not shown as the provision of suitable support means would present no problem to those skilled in the art. The glue 51 is a very fast setting glue, for example a hot melt glue. The glue trough is accordingly provided with suitable heating means which are not shown. The glue 51 must be selected with respect to its setting time so that the glue stripe 51.2 on the book block back 26, on the way from the stripe gluing station 30 to the cover applying station, taking into consideration the transport speed, has not yet set but remains sufficiently tacky that it will very soon thereafter reach sufficient strength.

Instead of transverse stripes of glue being applied to backs of the bookblocks, small points of fast setting glue can be applied in the corner or near the corner between the back and first and last pages, in order to provide an initial bond between the bookblock and the cover when the cover is applied as described below.

Figure 4:
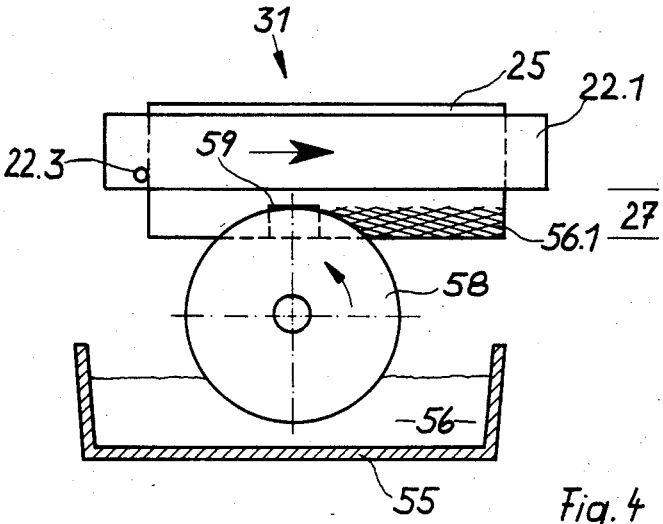
FIG. 4 is a schematic side view partially in section of means for applying adhesive to lower (rear) portions of first and last pages of a book block.
Figure 5:
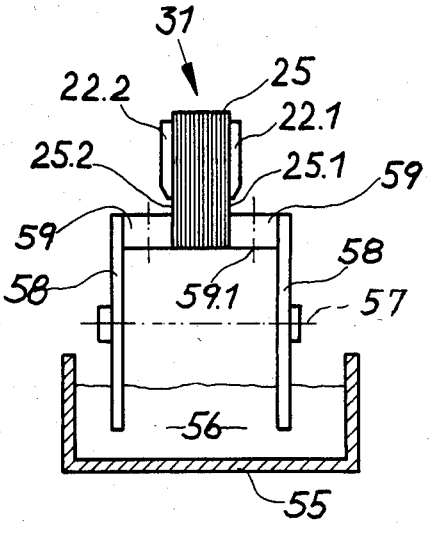
FIG. 5 is a schematic end view partially in section of the adhesive applying means of FIG. 4, omitting transport means.

Following the stripe gluing station 30, in the path of travel of the book blocks, is the side gluing station 31 illustrated in FIGS. 4 and 5. This likewise comprises a glue trough 55 containing glue 56. Two glue transport discs 58 rotating about a horizontal axis 57 dip constantly in the glue 56. Outer peripheral portions of the glue transport discs 58 engage side gluing rollers 59 rotating about vertical axes 59.1. The side gluing rollers 59 are formed as lattice rollers and apply to portions 27 of both outer sheets 25.1 and 25.2 near the back 26 a glue pattern 56.1 which, as illustrated schematically in FIG. 4, is a diamond shaped lattice pattern. In this manner the amount of glue applied can be accurately controlled with respect to the need. The book block 25 is shoved between the two side glue rollers 59 with sufficient contact to apply to the outer leaves of the book block glue supplied to the rollers 59 by the transport discs 58. The directions of movement are indicated by arrows in FIGS. 4 and 5.

Figure 6:
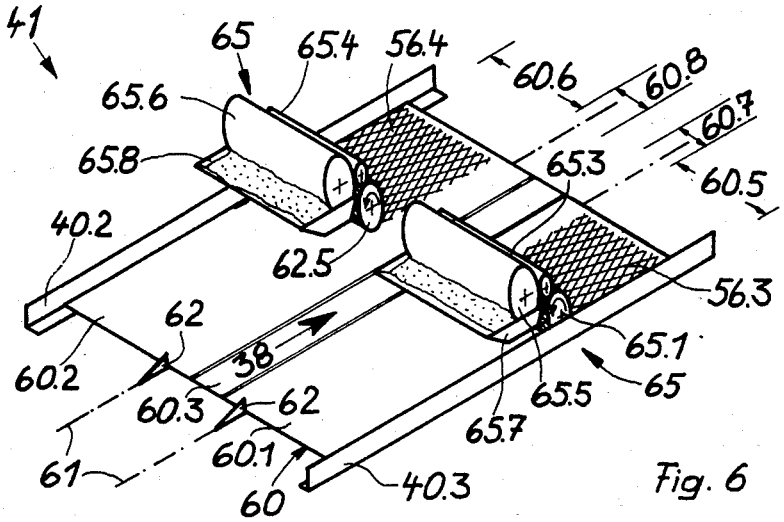
FIG. 6 is a schematic perspective view showing means for transporting and applying adhesive to portions of covers.

The cover feeder 40 is indicated only schematically in FIG. 1. It will suitably use a feed drum or a feed with horizontal movement to draw covers from the bottom of a stack. Such feeders are known. Such cover feeder lays a suitable cover 60 comprising front and back covers 60.1 and 60.2 together with a connecting back portion 60.3, formed for example of a single piece of cardboard, on a horizontal guide surface 40.1, the adjustable edge angles 40.2 and 40.3 of which are shown in FIG. 6. With the help of drawing means 61 two feed fingers 62 which engage a cover 60 are advanced in the direction of the arrow 38 in FIG. 6 to move the cover 60 to a cover gluing station 41.

One embodiment of the cover gluing station 41 is shown in FIG. 6. At the station 41 a separate glue-applying unit 65 is provided for applying glue to the forward portions 60.5 and 60.6 respectively of the covers 60.1 and 60.2. The glue applying units 65 comprise lattice glue rollers 65.1, 65.2 which rotate in the direction of movement of the covers and which receive glue from transfer rollers 65.3 and 65.4 respectively to which glue is supplied by supply rollers 65.5 and 65.6. The glue supply rollers 65.5 and 65.6 dip in glue troughs 65.7 and 65.8 respectively from which they pick up glue which is transferred by the transfer rollers 65.3,65.4 to the lattice glue rollers 65.1, 65.2. These in turn roll on the inner surfaces of the covers 60.1, 60.2 in the forward regions 60.5, 60.6 and produce there glue patterns 56.3 and 56.4 which, as seen in FIG. 6, are in the form of a diamond lattice. By further advance of the covers 60 by means of the tranport fingers 62, glue is applied to the full length of the forward portions 60.5,60.6 of the cover. There remain portions 60.7 and 60.8 extending to the back 60.3 to which no glue is applied. These portions correspond to the portions 27 on the respect outer pages of the book blocks 25 to which glue has been applied at station 31 as described above.

Figure 7:
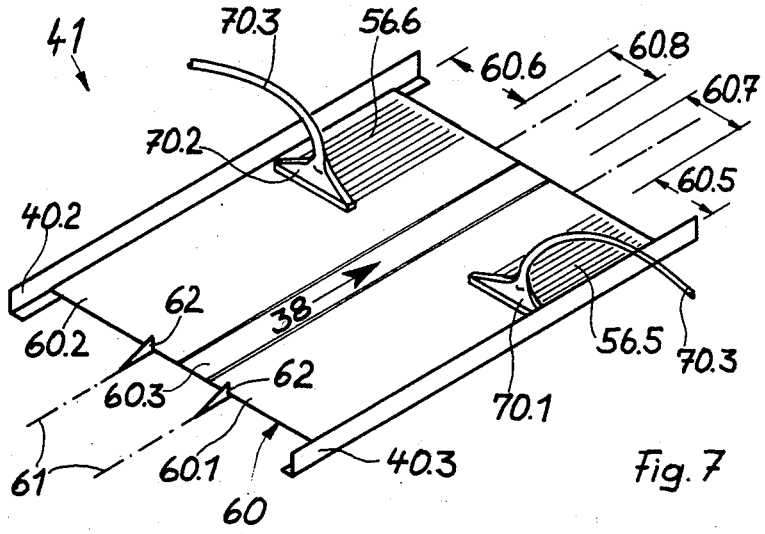
FIG. 7 is a schematic perspective view similar to FIG. 6 but showing other adhesive applying means.

FIG. 7 shows an alternative or variant for the configuration of the cover gluing station 41. Like elements are designated by the same reference numerals as in FIG. 6. Also here, cover 60 is advanced by the transport fingers 62. However, instead of the glue roller units 65, there are arranged glue nozzles 70.1 and 70.2 in the width of the forward portions 60.5 and 60.6 of the cover crosswise to the transport direction. The glue nozzles can be of known type and glue is supplied to them by conduits 70.3 and 70.4. Further apparatus for supplying these glue nozzles with glue corresponding to the cycle of the machine and exactly for the time corresponding to the length of the surface to be glued are not shown. They are of conventional type and have corresponding time control. They are also provided with corresponding adjustment of the rate at which glue is supplied. The glue patterns 56.5 and 56.6 formed by the glue nozzles are not in the form of nets but rather in the form of stripes as is well shown in FIG. 7.

Figure 8:
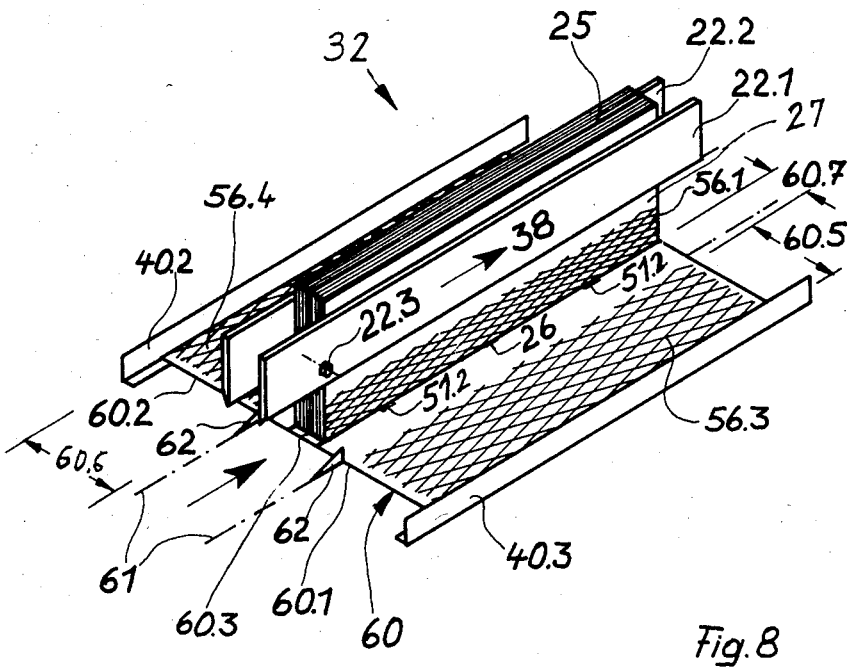
FIG. 8 is a schematic perspective view showing means for placing the cover in position with respect to the book block.
Figure 9:
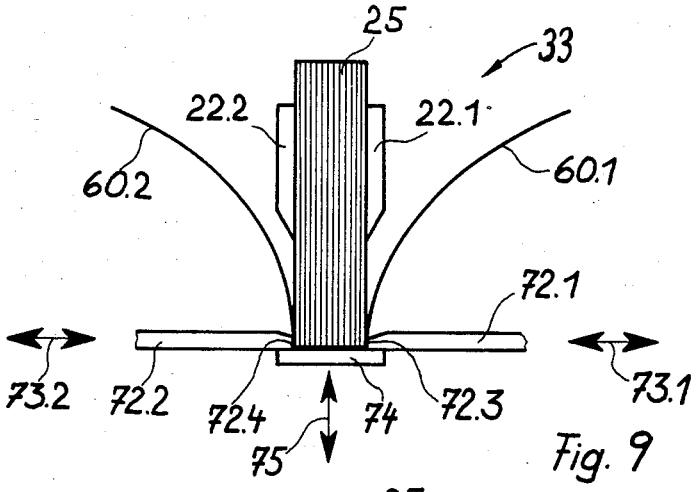
FIG. 9 is a schematic end view of a bookblock and cover side pressing station, omitting transport means.
Figure 10:
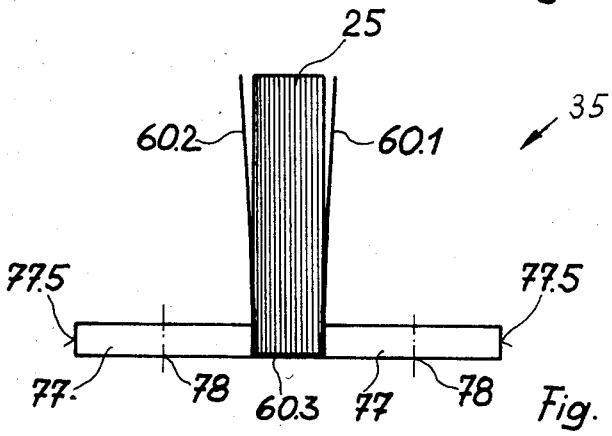
FIG. 10 is a schematic end view of the book block and cover at a roller pressing station.

The operation in the cover aligning station 32 is seen in FIG. 8. As seen in FIG. 1, station 32 is so arranged in the cycle of the cover delivery that the transport fingers 62 are aligned exactly with the positioning and feed pin 22.3 or are displaced according to the corresponding overhang of the book block so that in the operation of the machine the cover 60 is exactly aligned with the book block. Through corresponding relative movement of the cover and book block, particular through slight lifting of the back port 60.3, this is brought into contact with the still tacky glue stripes or points at the back of the book block 26 so that the aligned cover 60 is bonded fast on the book block 25. The rapidly setting glue can now harden while the slower setting glue on the inner faces of the covers and on the outer sheets of the book block still remains soft and tacky. The clamp 22 now takes the book block 25 together with the cover 60 and delivers it to the cover and side pressing station 33 which is illustrated in FIG. 9. As seen from FIG. 9, outer portions of the somewhat elastic covers 60.1 and 60.2 are raised, which can easily be done by upwardly inclining the horizontal guide rails 40.1 to 40.3. In order to produce a neat back with well formed corners and above all to press hinge portions of the unglued cover with the innermost parts of the areas 60.7 and 60.8 against the glued face portions 27 of the book block, there are provided horizontally moveable side press bars 72.1 and 72.2 with end edges 72.3 and 72.4 which press against rear portions of the cover 60.1 and 60.2. The side press bars 72.1 and 72.2 are firmly mounted and provided with means for moving them in the direction of the arrows 73.1 and 73.2 so as to press against the cover and then be withdrawn. The movement of the side pressed bars 72.1 and 72.2 can be coordinated with the movement of the book blocks so as to press the book blocks while the latter are moving. This can be accomplished with suitable crank mechanisms. At the same time a back pressure plate 74 presses upwardly in the direction of the arrow 75 to press the back of the cover against the back of the book block. The book block 25 is still held by the clamp 22 as seen in FIG. 9. The back pressing plate 74 is moved upwardly and then quickly withdrawn.

During the further transport of the book block 25 with the now pressed-on back and cover, the outer portions of the cover are further raised by suitable guide means, however not sufficiently for the glued surfaces of the cover to contact the clamps 22. When the particular book has arrived over the transport channel 34, the clamp 22 is opened and book falls on its back in the transport channel 34 and will then be further advanced by suitable transport means, first by the positioning and feed pin 22.3 and then by other transport means because the particular clamp 22 turns around the guide and drive wheel 21.1 and enters into another run in order to take a new book block. The transport means in the transport channel 24 moves the book further forwardly. At the same time, the transport channel narrows so that the still adhesive cover lifts itself and engages the outermost pages of the book block. The book now arrives at the roller pressing station 35 which, as seen from FIGS. 1 and 10, comprises four pressure rollers 77 which have vertical axes 78 and whose vertical circumferential faces 77.5 press the cover in a greater area than the pressure bars 72 in order to press the next cover area neatly and fold-free and for a good bond between the cover and the outermost leaves of the book block, or against the extending portions of the back gauze or the fold strip. Instead of the rollers, laterally movable pressure plates of corresponding height and movable with the book block can be used. Also, the book can be momentarily stopped during pressing.

Figure 11:
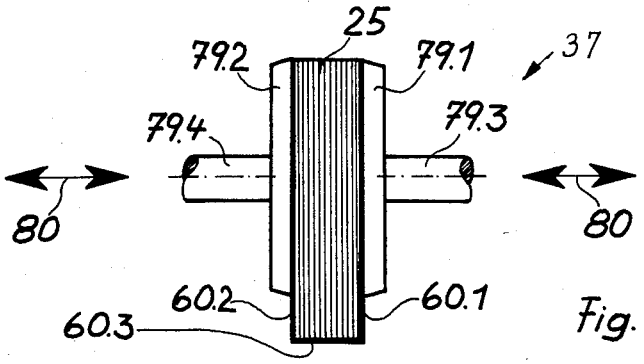
FIG. 11 is a schematic end view of a book block and cover at a final pressing station.

Following the roller pressing station 35 there is at least one plate pressing station, although it is desirable to have two plate pressing stations 36 and 37 as illustrated in FIG. 1. FIG. 11 illustrates only the second pressing station 37, it being understood that the pressing station 36 can be the same but works on another part of the book. The book is brought to the pressing station 37 through the transport system with the pressure plates open. When the pressure plates are brought into engagement with the book, they either move with the book or the book is momentarily stopped. The pressure plates 79.1 and 79.2 are fixed on press plunges 79.3 and 79.4 which are movable in the direction of the arrow 80 and in the manner known in book presses. However, here the press is for the purpose of laminating different areas of the glued cover and the outermost leaves of the book block so as to be bonded securely and permanently to one another. After opening of the pressure plates 79, the finished book is advanced in the transport channel 34 by means of the transport mechanism to the discharge 38 and can there either be stacked or delivered to other equipment for packing or storing. If necessary the book can also be trimmed on three sides if this has not already been done. This depends on the particular book type and binding method.

The embodiment of the invention in the process or in apparatus can be combined with other machines which operate differently in binding books. This applies especially to the binding method. For example, before glue stripes 56.1 are applied to the back of the book block, the back can be subjected to a milling operation followed by the application of glue and if necessary the application of gauze. Also, before the book block 25 is clamped, it can be provided with a folded insert. At the input station, means can be provided for heating thread bound and glue bound books with or without gauze. The auxiliary apparatus can be arranged in the area of the inlet. Also in book binding, usual stations can be interposed with stations for carrying out the invention in one and the same glue binding machine or in one and the same production line. Through the new developement, is is now possible to produce a high quality book with the rapidity of a collating machine or other glue binding.

FIGS. 12 to 22 illustrated schematically several book types and operations in order to illustrated essential distinguishing characteristics which books bound in accordance with the present invention can have. The examples are not exhaustive but point out several important features in the carrying out of the process.

Figure 12:
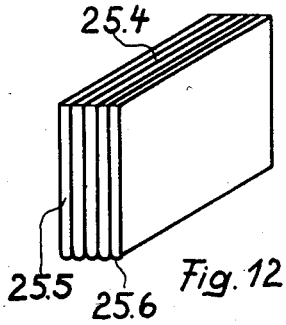
FIG. 12 is a schematic perspective view of a book block comprised of folded sheets.
Figure 13:
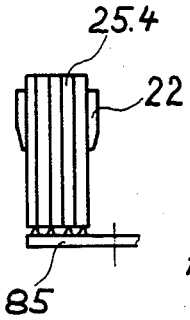
FIG. 13 is a schematic end view of a bookblock with back milling means.
Figure 14:
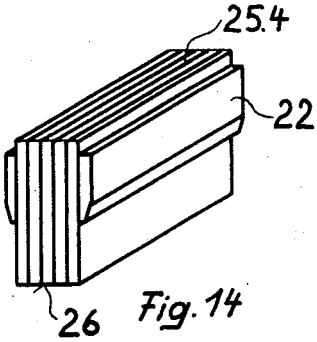
FIG. 14 is a schematic perspective view of the book block of FIG. 13 held by clamp means.
Figure 15:
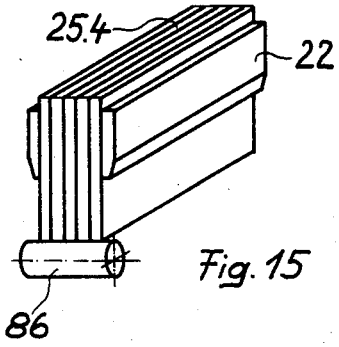
FIG. 15 is a schematic perspective view showing the application of adhesive to the back of the book block of FIG. 14.
Figure 16:
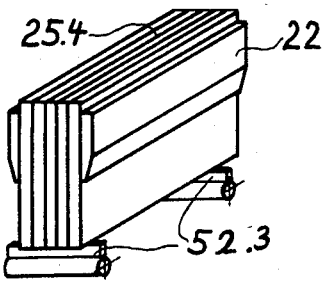
FIG. 16 is a schematic perspective view showing the application of stripes of adhesive to the back of the book block of FIG. 14.
Figure 17:
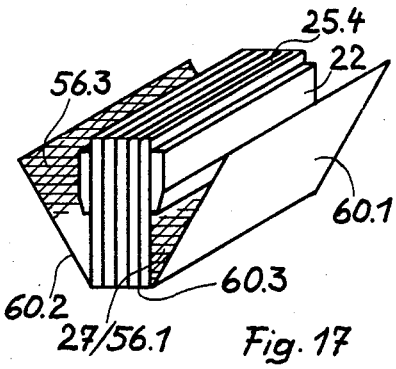
FIG. 17 is a schematic perspective view showing the application of a cover shortly before lamination of the cover and outer pages of the book block.
Figure 18:
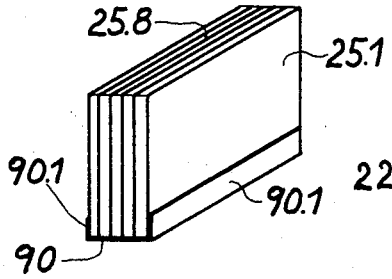
FIG. 18 is a schematic perspective view of a bookblock with a fold strip.
Figure 19:
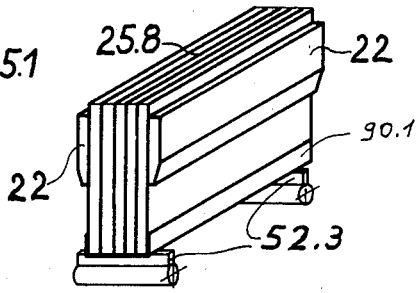
FIG. 19 is a schematic perspective view showing means for clamping the book block of FIG. 18 and applying stripes of adhesive to the back.

FIG. 12 illustrates a book block 25.4 which consists of individual folios 25.5 which are folded at 25.6. This book block 25.5 is to be glue bound. To accomplish this, FIG. 13 illustrates how the back 26 of the book block held by a clamp 22 is milled by a milling cutter 85 and then the book block, as shown in FIG. 14 with all four edges of the sheets open, glue is applied to the back 26 by a glue cylinder 86 as illustrated schematically in FIG. 15. When this operation is ended, and if necessary there is applied a gauze (not shown), there follows a stripe gluing station 30 with the help of glue stripe applicators 52.3 which apply stripes of fast setting glue as illustrated in FIG. 16. Thereafter, in the manner described above, glue is applied to both surface portions 27 or 56.1 and 60.5 or 60.6 as illustrated schematically in FIG. 17 thereafter the binding operation is completed as described above.

Figure 20:
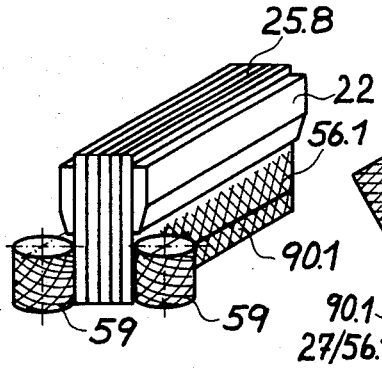
FIG. 20 is a schematic perspective view showing means for applying adhesive in a set pattern to lower (rear) portions of first and last pages of the book block of FIG. 19.
Figure 21:
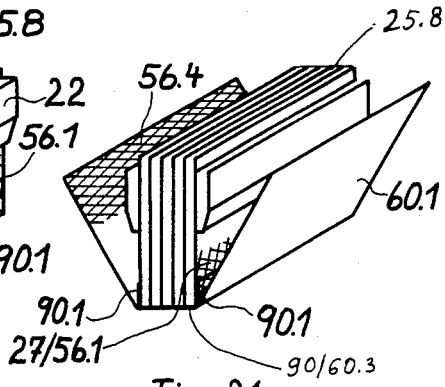
FIG. 21 is a schematic perspective view showing the application of a cover to the book block of FIG. 20 shortly before pressing of the faces to be laminated.

FIGS. 18 to 21 illustrate schematically a book block 25.8 to the back of which is applied a qauze strip or folded strip 90 of which extending edge portions 90.1 are interposed between the outermost sheets of the book block and the cover 60. Only the stripe gluing in FIG. 19 and the roller gluing of rear portions of the book block and the extensions 90.1 of the gauze strip or folded strip 90 in FIG. 20 are illustrated. Here it will be seen that the glue applied by glue rollers 59 extends over the edge portions 90.1 of the gauze strip or folded strip 90. FIG. 21 illustrates how the application of a cover 60 having glue applied to forward portions of the inner face thereof before pressing the cover on the glued edge portion 90.1 of the back gauze or fold strip 90 and subsequent to final pressing.

Figure 22:
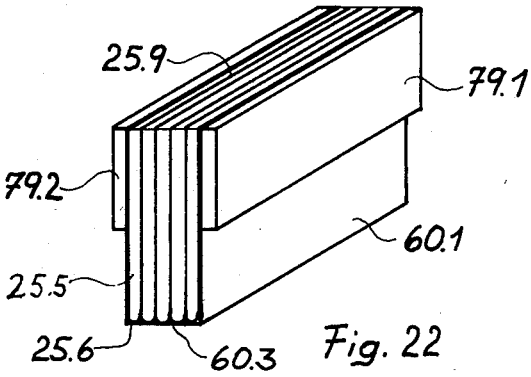
FIG. 22 is a schematic perspective view of a further embodiment of a thread bound book block in a last phase.

FIG. 22 illustrates the last phase of pressing of a book block 25.9 which is thread bound and the sheets 25.5 of which are folded at the back as is illustrated by the rounding 25.6. The overlayed cover 60 covers the binding produced by the usual thread binding and thus creates also for the thread bound book a rapid covering in a cover suitable for this mode of operation.

What I claim is:

1. Process of binding books comprising gripping and holding a bookblock having first and last pages and a back by a forward portion of the bookblock spaced from the back while applying adhesive to rear portions only of first and last pages of the bookblock, providing a case comprising front and back covers and a connecting back, applying adhesive to forward portions of inner surfaces of said front and back covers, bringing said back and rear portions of said front and back covers of said case into engagement with the back and the adhesively coated rear portions of first and last pages of said bookblock while so held, whereby said case is adhered to a rear portion of said bookblock, supporting said bookblock with said case by a rear portion thereof while releasing said forward portion of said bookblock, bringing adhesively coated forward portions of said front and back covers into engagement with forward portions of said first and last pages of said bookblock and pressing said cover firmly on said bookblock to bond said front and back cover of said case throughout to first and last pages of said bookblock.

2. Process according to claim 1, in which bookblocks are held suspended in an upright position with backs down by clamps gripping said forward portions and carried by a conveyor for moving said bookblocks through successive operating stations.

3. Process according to claim 2, in which at an operating station adhesive is applied in a pattern to backs of successive bookblocks for effecting an initial bond when the bookblocks are brought into engagement with respective covers.

4. Process according to claim 3, in which said bookblocks are carried by said clamps and conveyor over a rotating applicator dipping into an adhesive bath.

5. Process according to claim 3, in which said adhesive applied to the back is hot-melt glue.

6. Process according to claim 3, in which said adhesive applied in a pattern to backs of successive bookblocks is faster setting than said adhesive applied to rear portions of front and last pages of bookblocks.

7. Process according to claim 2, in which at an operating station adhesive is applied in a pattern to rear portions only of first and last pages of said bookblocks.

8. Process according to claim 7, in which said bookblocks pass between rollers to which adhesive is supplied and which engage near portions of first and last pages of said bookblocks.

9. Process according to claim 2, in which said cases lying flat with inner faces of said front and back covers up are transported along a path merging with the path along which said bookblocks are transported by said clamps and conveyor.

10. Process according to claim 9, in which, while said cases are thus transported, adhesive is applied to forward portions of said front and back covers spaced from the back.

11. Process according to claim 10, in which said front and back adhesive is applied to said covers in a pattern by rollers.

12. Process according to claim 10, in which said adhesive is applied to said front and back covers in a pattern by spray means.

13. Process according to claim 2, in which said bookblocks are brought into position on said cases with the back of the bookblock engaging the back of the case and with front and back covers folded up toward the bookblock.

14. Process according to claim 13, in which rear portions of the bookblocks with the cases thereon are gripped between opposed rollers whereupon said clamps are released and removed.

15. Process according to claim 14, in which the bookblocks with the cases thereon are thereafter pressed between opposed plates.

16. Apparatus for binding books comprising a plurality of clamps for gripping by upper portions bookblocks in a vertical position with backs down, means for conveying bookblocks held by said clamps, through successive operating stations, means for applying adhesive to rear portions only of first and last pages of bookblocks at an operating station, means for transporting cases comprising front and back covers with connecting back portions along a path merging with the path along which said bookblocks are conveyed by said clamps and conveying means with the inside of said covers facing up, means for applying adhesive to forward portions of said covers while thus transported, said transporting means bringing said cases with adhesive applied thereto beneath respective bookblocks gripped by said clamps, means for gripping said bookblocks with respective cases by rear portions thereof and thereupon releasing and removing said clamps, and means for pressing said front and back covers respectively on first and last pages of said bookblocks.

17. Apparatus according to claim 16, in which means for applying adhesive to backs of said bookblocks comprises a rotating element dipping into an adhesive bath and engaging backs of said bookblocks at spaced areas as they pass over said bath.

18. Apparatus according to claim 16, in which said means for applying adhesive to rear portions of first and last pages of said bookblocks comprise rollers engaging said bookblock from opposite sides.

19. Apparatus according to claim 16, in which said means for applying adhesives to forward portions of said covers comprise rollers under which said covers are transported by said transporting means.

20. Apparatus according to claim 16, in which said means for applying adhesive to forward portions of said covers comprise spray heads under which said covers are transported by said transporting means.

21. Apparatus according to claim 16, in which said means for gripping said bookblocks and cases by rear portions thereof comprise opposed rollers.

22. Apparatus according to claim 16, in which said means for pressing said front and back covers on said first and last pages respectively of said bookblocks comprise opposed plates and means for moving said plates toward one another.

23. Process of binding books comprising the steps of gripping bookblocks successively by clamps carried by a conveyor, said clamps holding said bookblocks by forward portions only with the bookblocks suspended in vertical position with backs down and rear portions of first and last pages of said bookblocks exposed, transporting the bookblocks thus held by said clamps to and through an adhesive applying station, at said adhesive applying station applying adhesive to exposed rear portions only of first and last pages while the bookblocks are still held by said clamps, successively providing cases each comprising front and back covers and a connecting back, applying adhesive to forward portions of said front and back covers, bringing the back and the rear portions of said front and back covers of said cases successively into engagement with the back and the adhesively coated rear portions of first and last pages of successive bookblocks while the bookblocks are still held by said clamps, whereby said cases are adhered to respective bookblocks, supporting said bookblocks and respective cases by rear portions thereof while successively releasing and removing said clamps, thereupon bringing adhesively coated forward portions of said front and back covers successively into engagement with said forward portions of first and last pages of said bookblocks and pressing said covers firmly on said bookblocks to bond said covers throughout to first and last pages of said bookblocks.

24. Process according to claim 23, in which at said adhesive applying station, adhesive is applied in a selected pattern to backs of successive bookblocks, the adhesive applied to the backs having the property of setting more rapidly than adhesive applied to rear portions of said first and last pages.

* * * * *